United States Patent [19]

Levenson et al.

[11] 4,188,192

[45] Feb. 12, 1980

[54] FIRE IGNITING METHOD AND APPARATUS

[76] Inventors: Sol J. Levenson; Michael K. Levenson, both of 2636 S. Belvoir Blvd., University Hts., Ohio 44118

[21] Appl. No.: 674,885

[22] Filed: Apr. 8, 1976

[51] Int. Cl.[2] ..... C10L 11/00

[52] U.S. Cl. ..... 44/39

[58] Field of Search ..... 44/39

[56] References Cited

U.S. PATENT DOCUMENTS

| | | | |
|---|---|---|---|
| 3,402,029 | 9/1968 | Sampson, Jr. et al. | 44/39 |
| 3,927,993 | 12/1975 | Griffin | 44/39 |

*Primary Examiner*—Carl F. Dees

[57] ABSTRACT

Fire igniting apparatus comprising a shaving stock member formed of a shavable magnesium base alloy and a pyrophoric element secured to the shaving stock member and defining an exposed or exposable surface thereof.

The method of igniting a fire which burns with a dazzling white flame by forming finely divided particulates of a magnesium base alloy, consolidating the particulates in close proximity to combustible kindling and striking a pyrophoric element so as to produce a spark which contacts and ignites the particulates causing the same to burn with a dazzling white flame and ignite the combustible kindling.

6 Claims, 2 Drawing Figures

FIRE IGNITING METHOD AND APPARATUS

This invention relates to an improved fire igniting method and apparatus.

BACKGROUND OF THE INVENTION

Expanded interest in protecting the environment, and in participation in camping, backpacking and other outdoor activities, has given rise to a demand for safe, reliable and lightweight fire igniting apparatus for lighting campfires and the like. The present invention is addressed to satisfying this demand.

The match is presently the most common material used for starting fires outdoors. Matches suffer a number of disadvantages. They are relatively ineffectual under high wind conditions. The quantity and duration of heat generated is frequently insufficient to ignite damp kindling, particularly at low ambient temperatures. Matches themselves, unless waterproof, will not work when they become wet. Because matches are disposable, they are wasteful and lend themselves to being disposed of carelessly, frequently resulting in the ignition of uncontrolled fires.

The present invention obviates the various disadvantages of matches by providing a fire igniting apparatus which can be used repeatedly, produces a very high temperature ignition flame of variable duration, reliably produces ignition under adverse wind and moisture conditions, and leaves virtually no residue.

The fire igniting method of the present invention involves the steps of shaving a body formed of a magnesium base alloy to form finely divided particulates of the alloy, consolidating the particulates in close proximity to combustible kindling, and striking a pyrophoric element in a manner to produce a spark which contacts and ignites the particulates, causing the same to burn with a dazzling white flame and ignite the combustible kindling.

The novel fire igniting apparatus comprises a shaving stock member consisting of a body formed of a shavable magnesium base alloy and a pyrophoric element secured to the body and defining an exposed or exposable surface thereof. The apparatus provides a single composite structure serving both as a source of shavable magnesium base alloy and as a spark generating material for igniting the magnesium base alloy, to produce the characteristic dazzling white flame of burning magnesium.

THE PRIOR ART

U.S. Pat. No. 3,402,029 relates to "an alloyed composition of misch metal and magnesium" and to a method of kindling fires with the same.

The patentee states that his composition can contain from 50% down to 0.5% magnesium and still be operative. The compositions containing 2% to 20% magnesium and 80% to 98% misch metal have, according to the inventor, been found to have the most desirable properties. Compositions which contain more than 98% misch metal are said to be too soft while compositions containing less than 50% misch metal do not strike a spark readily.

According to the teachings of U.S. Pat. No. 3,402,029, the identical composition of misch metal and magnesium which serves as a source of magnesium also serves as the pyrophoric material used to ignite the magnesium.

In discussing the ignition of pure magnesium, the patentee notes that the metal burns with a dazzling white flame and produces a substantial amount of heat in the temperature range of 2700° C. to 2900° C. By contrast, when discussing the ignition of its alloyed composition of misch metal and magnesium, the inventor merely speaks in terms of the composition "igniting" and burning at a temperature within the range of 2800° F. (1538° C.) It is thus apparent, according to the teachings of U.S. Pat. No. 3,402,029, that the misch metal magnesium composition it discloses does not burn with a dazzling white flame, nor does it burn at a temperature within the range of 2700° C. to 2900° C.

Our testing of a commercial embodiment of an igniting device bearing U.S. Pat. No. 3,402,029, confirmed that the alloyed composition used therein (which by analysis contained about 85% misch metal and about 0.9% magnesium) does not burn with a flame, but rather merely with a red glow. This indicates that the temperature obtained falls far below the range of 2700° C. to 2900° C. which is attendant the dazzling white flame characteristically produced when magnesium burns. We estimate that the temperature of the red glow fell within the range of about 1000° C. to 1500° C.

Without desiring to be limited to any particular theory of operation, it is postulated that the absence of flame during the ignition and burning of the misch metal magnesium alloy composition described in U.S. Pat. No. 3,402,029 is attributable to the alloy inducing the rapid formation of thermal insulating oxides which greatly reduces the ability of the alloy to transfer heat to combustible kindling.

This reduces significantly the usefulness of the prior art alloy composition in providing ignition under adverse weather conditions. For example, the method of the present invention can be practiced by depositing magnesium base alloy shavings in a depression in the ground to protect them from high winds. Combustible kindling can then be laid at and above ground surface above the depression. Because of the dazzling white flame and high temperatures attendant the burning of the magnesium base alloy, and the "reach" of the flame, the combustible kindling readily ignites. By contrast, burning the misch metal magnesium alloys of the prior art produces only a red glow and substantially lower temperatures, which disallows the transfer of heat from a depression in the ground to combustible kindling disposed at or about ground level.

Other advantages of our fire igniting apparatus over that disclosed in U.S. Pat. No. 3,402,029 are cost and weight. Misch metal costs approximately $5.00 per pound, compared with commercially available magnesium base alloys which cost within the range of $0.85 to $0.95 per pound. Moreover, misch metal has a density of about 6.0 grams per cubic centimeter, while commercially available magnesium base alloys have a density within the range of about 1.7 to 2.2 grams per cubic centimeter.

SUMMARY OF THE INVENTION

In brief, the fire igniting apparatus of the present invention comprises a composite structure having two distinct components. The first consists of a shavable magnesium base alloy, and the second a pyrophoric element. The two materials are preferably secured together in such a manner that when a fire is to be ignited, there is available to the person using the apparatus, a surface of the shavable magnesium base alloy and a surface of the pyrophoric element. This arrangement can be effected in a number of different ways, examples of which will be described in detail below.

In the practice of the method of the invention, an instrument such as a pen knife blade, file or the like is frictionally engaged against a surface of the shavable magnesium base alloy to produce finely divided particulates of the alloy. These particulates are consolidated in close proximity to combustible kindling. Thereafter, the same knife blade, file or the like instrument is brought into striking engagement against the surface of the pyrophoric element in a manner to produce a spark. Upon contact, the spark ignites the particulates of the magnesium base alloy, causing the particulates to burn with a dazzling white flame characteristic of burning magnesium, and ignite the combustible kindling.

BRIEF DESCRIPTION OF THE DRAWINGS

Referring now to the drawings wherein like reference numerals indicate like parts in the various views.

DESCRIPTION OF THE PREFERRED EMBODIMENT

Figure 1:
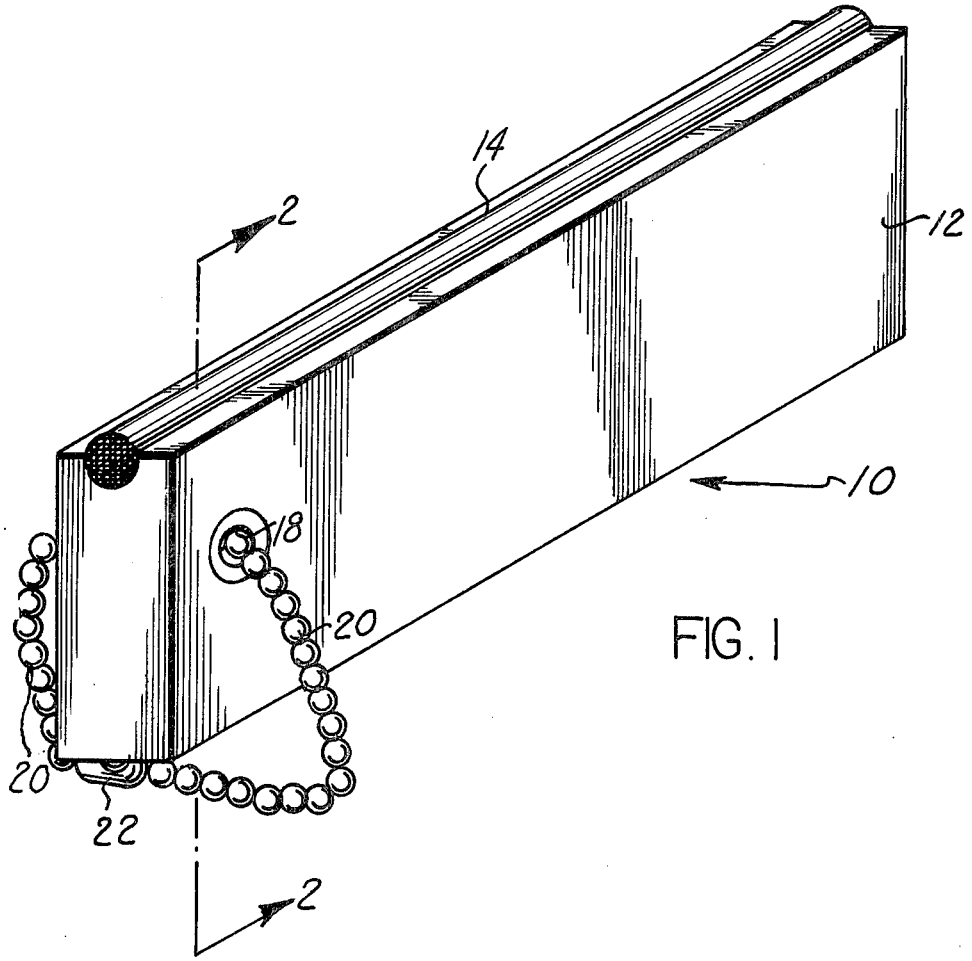
FIG. 1 is a perspective view of one embodiment of the fire igniting apparatus of the present invention.

Referring now in detail to the drawings, FIG. 1 illustrates an embodiment of a fire igniting apparatus designated generally as 10, comprising a shaving stock member 12 consisting of a body formed of a shavable magnesium base alloy, and pyrophoric element 14 secured to body 12 and defining an exposed surface thereof.

Figure 2:
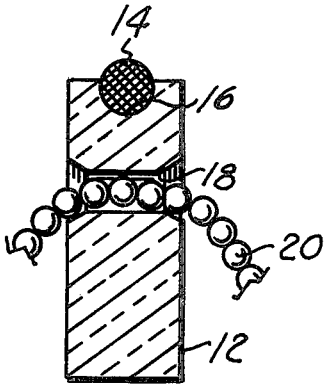
FIG. 2 is a sectional view taken along line 2—2 of FIG. 1.

Directing attention to the upper surface of body 12 as shown in the drawing, there is provided in the surface, recess 16 conforming generally to the shape of pyrophoric element 14, which in the embodiment illustrated takes the form of a circular rod. As best illustrated in FIG. 2, a portion of pyrophoric element 14 protrudes above the surface in which it is mounted for access by a spark generating scraping means, such as a pen knife or a file.

In the embodiment illustrated in the drawings, the pyrophoric element is adhesively secured to the body of magnesium base alloy (adhesive not illustrated). It will be appreciated, however, that other means for securing the pyrophoric element to the body of shavable magnesium alloy may be provided. These may include set screws, spring clamps, or other similar mechanical devices, or more simply, a press fit within an embracing portion of the shaving stock body. As will be readily appreciated by one skilled in the art, the mechanical devices for securing the pyrophoric element to the magnesium alloy body should be designated so as not to interfere with the scraping action.

It is also within the contemplation of the present invention to provide a hinged body of magnesium base alloy which will completely embrace and protect the pyrophoric element when the apparatus is in a storage mode. Upon folding back one of the hinged sections of the magnesium base alloy, the pyrophoric element is rendered available for use by protrusion above an exposable surface of the magnesium base alloy body.

Turning again to FIG. 1, it will be seen that shaving stock member 12 is provided with aperture 18 through which a chain 20 is disposed. The chain is provided with catch 22 for opening and closing the chain, facilitating the apparatus being hung from a belt loop or the like.

Shaving stock member 12 may be formed from any magnesium base alloy, which for purposes of this disclosure, is defined as an alloy containing more than 50 wt.% of magnesium. As a practical consideration, commercially available magnesium base alloys contain at least about 85 wt.% magnesium, and consequently, these are the only alloys which we have been able to experiment with. However, we believe that other magnesium base alloys, as defined herein, if available, would be useful for purposes of the present invention, provided they are shavable with a knife blade or the like, and are further characterized by being ignitable in finely divided form by a spark from a pyrophoric element, and by burning with a dazzling white flame.

The balance of the commercially available magnesium base alloys which contain at least about 85% magnesium, is formed substantially of one or more elements selected of the group consisting of aluminum, manganese, zinc, thorium, zirconium and the rare earths. For purposes of this disclosure, the term "rare earths" is intended to have the definition recommended by the Commission on Nomenclature of the International Union of Pure and Applied Chemistry. The Commission defines "rare earths" as consisting of 17 elements, namely, scandium, yttrium, and the 15 elements having the atomic numbers 57 through 71 for which the International Union recommends the term "Lanthanum Series".

The commercially available magnesium base alloys may also contain trace amounts of calcium, copper, iron, nickel and silicon.

ASTM wrought magnesium base alloys which may be used in the practice of the invention include the following, which contain from about 89% to 98% by weight of magnesium:

TABLE I

| | Chemical Composition, % | | | | | | | | | | | | |
|---|---|---|---|---|---|---|---|---|---|---|---|---|---|
| ASTM Alloy | Al | Mn, Min. | Zn | Zr | Rare Earths | Th | Ca | Si, Max. | Cu, Max. | Ni, Max. | Fe, Max. | Other Imp., Max. | Mg. |
| AZ31B | 2.5–3.5 | 0.20 | 0.7–1.3 | — | — | — | 0.04max. | 0.30 | 0.05 | 0.005 | 0.005 | 0.30 | Bal. |
| AZ31C | 2.5–3.5 | 0.20 | 0.6–1.4 | — | — | — | 0.04max. | 0.30 | 0.10 | 0.03 | — | 0.30 | Bal. |
| AZ61A | 5.8–7.2 | 0.15 | 0.4–1.5 | — | — | — | — | 0.30 | 0.05 | 0.005 | 0.005 | 0.30 | Bal. |
| AZ80A | 7.8–9.2 | 0.15 | 0.2–0.8 | — | — | — | — | 0.30 | 0.05 | 0.005 | 0.005 | 0.30 | Bal. |
| M1A | — | 1.20 | — | — | — | — | 0.08–0.14 | 0.30 | 0.05 | 0.01 | — | 0.30 | Bal. |
| HM21A | — | 0.35–0.80 | — | — | — | 1.5–2.5 | — | — | — | — | — | 0.30 | Bal. |
| HM31A | — | 1.2 | — | — | — | 2.5–3.5 | — | — | — | — | — | 0.30 | Bal. |
| ZE10A | — | — | 1.0–1.5 | — | 0.12–0.22 | — | — | — | — | — | — | 0.30 | Bal. |
| ZK11 | — | — | 1.3 | 0.7 | — | — | — | — | — | — | — | — | Bal. |
| ZK31 | — | — | 3.0 | 0.7 | — | — | — | — | — | — | — | — | Bal. |
| ZK60A | — | — | 4.8–6.2 | 0.45min. | — | — | — | — | — | — | — | 0.30 | Bal. |

ASTM magnesium casting alloys which are useful in the practice of the invention include the following, which contains from about 87% to about 95% by weight of magnesium:

TABLE II

Chemical Compositions, %

| ASTM Alloy | Al | Mn. Max. | Zn | Zr | Rare Earths | Th | Si, Max. | Cu, Max. | Ni, Max. | Other Imp. Max. |
|---|---|---|---|---|---|---|---|---|---|---|
| AM100A | 9.3–10.7 | 0.10 | 0.30max. | — | — | — | 0.30 | 0.10 | 0.01 | 0.30 |
| AZ63A | 5.3–6.7 | 0.15 | 2.5–3.5 | — | — | — | 0.30 | 0.10 | 0.01 | 0.30 |
| AZ81A | 7.0–8.1 | 0.13 | 0.4–1.0 | — | — | — | 0.30 | 0.10 | 0.01 | 0.30 |
| AZ91A | 8.3–9.7 | 0.13 | 0.4–1.0 | — | — | — | 0.50 | 0.10 | 0.01 | 0.30 |
| AZ91B | 8.1–9.7 | 0.13 | 0.4–1.0 | — | — | — | 0.50 | 0.30 | 0.01 | 0.30 |
| AZ91C | 8.3–9.7 | 0.10 | 1.6–2.4 | — | — | — | 0.30 | 0.10 | 0.01 | 0.30 |
| AZ92A | 8.3–9.7 | 0.10 | 1.6–2.4 | — | — | — | 0.30 | 0.10 | 0.01 | 0.30 |
| EK30A | — | — | 0.3max. | 0.20min. | 2.5–4.4 | — | — | — | — | 0.30 |
| EK41A | — | — | 0.3max. | 0.40–1.0 | 3.0–5.0 | — | — | — | — | 0.30 |
| EZ33A | — | — | 2.0–3.5 | 0.50–1.0 | 2.5–4.0 | — | — | — | — | 0.30 |
| HK31A | — | — | — | 0.50–1.0 | — | 2.5–4.0 | — | — | — | 0.30 |
| HZ32A | — | — | 1.7–2.5 | 0.05–1.0 | 0.10 | 2.5–4.0 | — | — | — | 0.30 |
| ZE41A | — | — | 3.5–5.0 | 0.40–1.0 | 0.75–1.75 | — | — | — | — | — |
| ZK51A | — | — | 3.6–5.5 | 0.55–1.0 | — | — | — | — | — | 0.30 |
| ZH62A | — | — | 5.2–6.2 | 0.50–1.0 | — | 1.4–2.2 | — | — | — | 0.30 |

Particularly useful alloys are those bearing the ASTM alloy designations AZ91B, AM100A, AZ92, M1B, and AZ31C, of which the last is the most preferred.

The method of the invention is practiced in the following manner. A knife blade, file or other scraping instrument is brought into frictional engagement with a surface of the shavable magnesium base alloy body, and finely divided particulates of the magnesium base alloy are formed. These particulates are consolidated in close proximity to combustible kindling so that when the particulates are ignited and begin to burn, the intense heat can quickly be transferred to the combustible kindling.

The pyrophoric element is then positioned near the consolidated particulates and the element is struck with a tool which may be the same knife blade or file used to prepare the particulates of magnesium base alloy. Sparks generated by the tool striking against the pyrophoric element are directed toward the particulates, igniting them and causing the same to burn with a dazzling white flame. This flame in turn heats and ignites the combustible kindling.

For purposes of this disclosure, the term "pyrophoric" is intended to define any material which produces sparks when abraded with a hard surface such as a knife edge. Classes of materials which have this property include metals, alloys of metals, non-metals, alloys of metals and non-metals, and certain minerals such as flint and pyrite. Specific alloys possessing pyrophoric properties include zirconium-tin alloys, zirconium-lead alloys and zirconium-titanium-lead alloys.

The most commonly used pyrophoric materials are misch metal and misch metal alloys. For purposes of this disclosure, we adopt a generally recognized definition for "misch metal," which is a mixture of cerium, lanthanum and neodymium. See for example, Webster's Third New International Dictionary, 1971. Most commercially available forms of misch metal find the material alloyed with magnesium, iron, ferroalloys and the like.

While the invention has been described with reference to certain specific embodiments, variations thereof within the perview of those skilled in the art will come immediately to mind. For example, it is within the contemplation of the present invention to provide the shaving stock member of the apparatus with a sliding drawer or other recesses to accommodate extra pyrophoric elements, a scraping tool, or other small items of camping gear. Further, the entire fire igniting apparatus may be incorporated in another conventional piece of camping equipment such as a flashlight, knife handle or the like.

Having thus described our invention, we claim:

1. As fire igniting apparatus, a composite structure comprising
   (a) a shaving stock member consisting of a body formed of a shavable magnesium base alloy, shavings of which burn with a dazzling white flame when ignited from a spark from a pyrophoric material, said alloy containing more than 50 wt.% magnesium, the balance of said alloy being formed substantially of one or more elements selected from the group consisting of Al, Mn, Zn, Th, Zr and the rare earths, and
   (b) a pyrophoric element secured to said shaving stock member and defining an exposed or exposable surface thereof.

2. Apparatus as defined in claim 1 wherein said magnesium base alloy contains at least about 85% magnesium.

3. Apparatus as defined in claim 1 wherein said pyrophoric element is selected from the group consisting of misch metal and misch metal alloys.

4. Apparatus as defined in claim 1 wherein said pyrophoric element is formed in the shape of a rod and said shaving stock member is provided with a recess dimensioned to snugly receive a portion of said rod-shaped pyrophoric element.

5. Fire igniting apparatus comprising a generally rod-shaped element of pyrophoric material mounted in a conforming recess in a surface of a body formed of a shavable magnesium base alloy, shavings of which burn with a dazzling white flame when ignited from a spark from a pyrophoric material, said alloy containing more than 50 wt.% magnesium, at least a portion of said rod protruding above the surface in which it is mounted, for access by spark-generating scraping means.

6. Apparatus as defined in claim 5 in which said generally rod-shaped element has a generally circular cross-section.

* * * * *